US011693350B2

(12) United States Patent
Shimizu et al.

(10) Patent No.: US 11,693,350 B2
(45) Date of Patent: Jul. 4, 2023

(54) IMAGE FORMING APPARATUS

(71) Applicant: KYOCERA Document Solutions Inc., Osaka (JP)

(72) Inventors: Tamotsu Shimizu, Osaka (JP); Kazunori Tanaka, Osaka (JP); Yasuhiro Tauchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/858,446

(22) Filed: Jul. 6, 2022

(65) Prior Publication Data

US 2023/0026905 A1 Jan. 26, 2023

(30) Foreign Application Priority Data

Jul. 14, 2021 (JP) ..... 2021-116244

(51) Int. Cl.
*G03G 15/08* (2006.01)
*G03G 15/00* (2006.01)

(52) U.S. Cl.
CPC ..... *G03G 15/80* (2013.01)

(58) Field of Classification Search
USPC ..... 399/174
See application file for complete search history.

(56) References Cited

U.S. PATENT DOCUMENTS

2004/0071477 A1* 4/2004 Do ..... G03G 15/0813 399/53

FOREIGN PATENT DOCUMENTS

JP S 61-190362 A 8/1986
JP 2007-033631 A 2/2007

* cited by examiner

*Primary Examiner* — Quana Grainger
(74) *Attorney, Agent, or Firm* — Stein IP, LLC

(57) ABSTRACT

An image forming apparatus includes an amorphous silicon photosensitive member, a developing device including a developer carrying member that carries a two-component developer, and a control portion. When a potential difference V0−Vdc between the photosensitive member and the developer carrying member has a first potential difference at which the toner is moved from the developer carrying member to the photosensitive member and a second potential difference at which the toner is moved from the photosensitive member to the developer carrying member, the control portion adjusts V0 or Vdc so that the first potential difference and the second potential difference are equal in value and opposite in polarity, and a first development current |Ia| that flows at the first potential difference and a second development current |Ib| that flows at the second potential difference satisfy $1.9\times10^{-2}\geq|Ib|/N\geq5.7\times10^{3}$ [μA/mm].

9 Claims, 4 Drawing Sheets

IMAGE FORMING APPARATUS

INCORPORATION BY REFERENCE

This application is based upon and claims the benefit of priority from the corresponding Japanese Patent Application No. 2021-116244 filed on Jul. 14, 2021, the entire contents of which are incorporated herein by reference.

BACKGROUND

The present disclosure relates to an image forming apparatus including an image carrying member, such as a copy machine, a printer, a facsimile, or a multi-functional peripheral having functions thereof. The present disclosure relates particularly to an image forming apparatus including a developing device that employs a two-component development method using a two-component developer including a toner and a carrier.

In an image forming apparatus, an electrostatic latent image formed on an image carrying member formed of a photosensitive member or the like is developed by a developing device into a visible toner image. One type of such a developing device employs the two-component development method using a two-component developer.

In the two-component development method, when a carrier resistance is low, carrier development in which a carrier moves onto the photosensitive member and a development leak become likely to occur, and an electric charge injection into an electrostatic latent image on the photosensitive member also becomes likely to occur. When the electric charge injection occurs, the electrostatic latent image changes to cause deterioration in image reproducibility. Furthermore, when the carrier resistance is high, there occur an insufficient image density, periodic unevenness in image density due to a variation in clearance (development gap) between the photosensitive member and a developing roller, edge enhancement in which a density of an image in an edge part thereof is increased, and so on. Particularly, when an amorphous silicon photosensitive drum having a high relative dielectric constant is used in the two-component development method, carrier development and a development leak are likely to occur. Meanwhile, in order to ensure an image density, the higher the carrier resistance, the higher a required Vpp.

A conventional way of reducing the above-described troubles has been to increase the carrier resistance so as to suppress carrier development and a development leak and to set a peak-to-peak value (Vpp) of an alternating-current component of a development voltage relatively high so as to prevent a decrease in image density due to the increase in the carrier resistance.

However, increasing the carrier resistance necessitates the Vpp of the development voltage to be increased, resulting in a trouble that a leak diameter of a development leak at the onset thereof is increased. In a development leak, which might occur when a distal end of a magnetic brush is in proximity to the photosensitive member, each magnetic brush bristle has a resistance varying with its height, diameter, or the like. Electric discharge conditions in a space in which electric discharge is started (a space created by the photosensitive member and a distal end of a magnetic brush) are the same for a low-resistance carrier and a high-resistance carrier, and when an initial minute leak occurs, a conductive path is formed in the magnetic brush. When the conductive path is formed, the larger a potential difference applied thereto, the larger an electric current flowing there-through. As a result, a large leak mark might be generated in a case of the high-resistance carrier.

With the Vpp of the development voltage increased, an occurrence level of an initially occurring leak is about one per several thousands of printed sheets, and a leak mark generated at this time is small, so that the occurrence of a leak is hardly perceivable at this level. Further, as the number of occurring leaks increases, the occurrence of a leak becomes perceivable. The higher the carrier resistance, the larger a diameter of a leak mark generated when the occurrence of a leak starts to become perceivable (an initial-stage leak).

In a case of using an amorphous silicon photosensitive member, a leak mark is likely to be generated in a blank region thereof for the following reason. That is, in an image region of the photosensitive member, a toner layer is formed thereon and functions as a resistance layer to suppress the occurrence of a leak. Also in a case of using an organic (OPC) photosensitive member, while a toner layer functions as a resistance layer in an image region thereof, a blank region current is originally unlikely to flow in the organic (OPC) photosensitive member, and thus a leak toward a blank region thereof is unlikely to occur. Meanwhile, there has been a problem that when a toner charge amount is increased to ensure environmental stability, the image density cannot be increased.

SUMMARY

An image forming apparatus according to one aspect of the present disclosure includes a photosensitive member, a charging device, an exposure device, a developing device, a development voltage power supply, and a control portion. The photosensitive member has a surface on which an amorphous silicon photosensitive laver is formed. The charging device charges the surface of the photosensitive member to a prescribed surface potential. The exposure device performs exposure with respect to the surface of the photosensitive member so as to form an electrostatic latent image thereon. The developing device includes a developer carrying member that is arranged to be opposed to the photosensitive member and carries a two-component developer including a toner and a carrier. The developing device causes the toner to adhere to the electrostatic latent image formed on the photosensitive member so as to form a toner image thereon. The development voltage power supply applies, to the developer carrying member, a development voltage obtained by superimposing an alternating-current voltage on a direct-current voltage. The control portion controls the charging device, the exposure device, the developing device, and the development voltage power supply. In the image forming apparatus, when a surface potential of the photosensitive member during image formation is indicated as V0 and a direct-current component of the development voltage to be applied to the developer carrying member as Vdc, and a potential difference V0−Vdc between the photosensitive member and the developer carrying member has a first potential difference in a direction in which the toner is moved from the developer carrying member to the photosensitive member and a second potential difference in a direction in which the toner is moved from the photosensitive member to the developer carrying member, the control portion adjusts V0 or Vdc so that the first potential difference and the second potential difference are equal in value and opposite in polarity, and when a first development current that flows between the photosensitive member and the developer carrying member at the first potential difference is indicated as |Ia| and a second development current that flows between the photosensitive member and the developer carrying member at the second potential difference as |Ib|, the second development current |Ib| satisfies Expression (1) below:

$$1.9\times10^{-2}\geq|Ib|/N\geq5.7\times10^{-3}[\mu A/mm] \quad (1)$$

where N denotes an axial length [mm] along which a magnetic brush on the developer carrying member is in contact with the photosensitive member.

DETAILED DESCRIPTION

Figure 1:
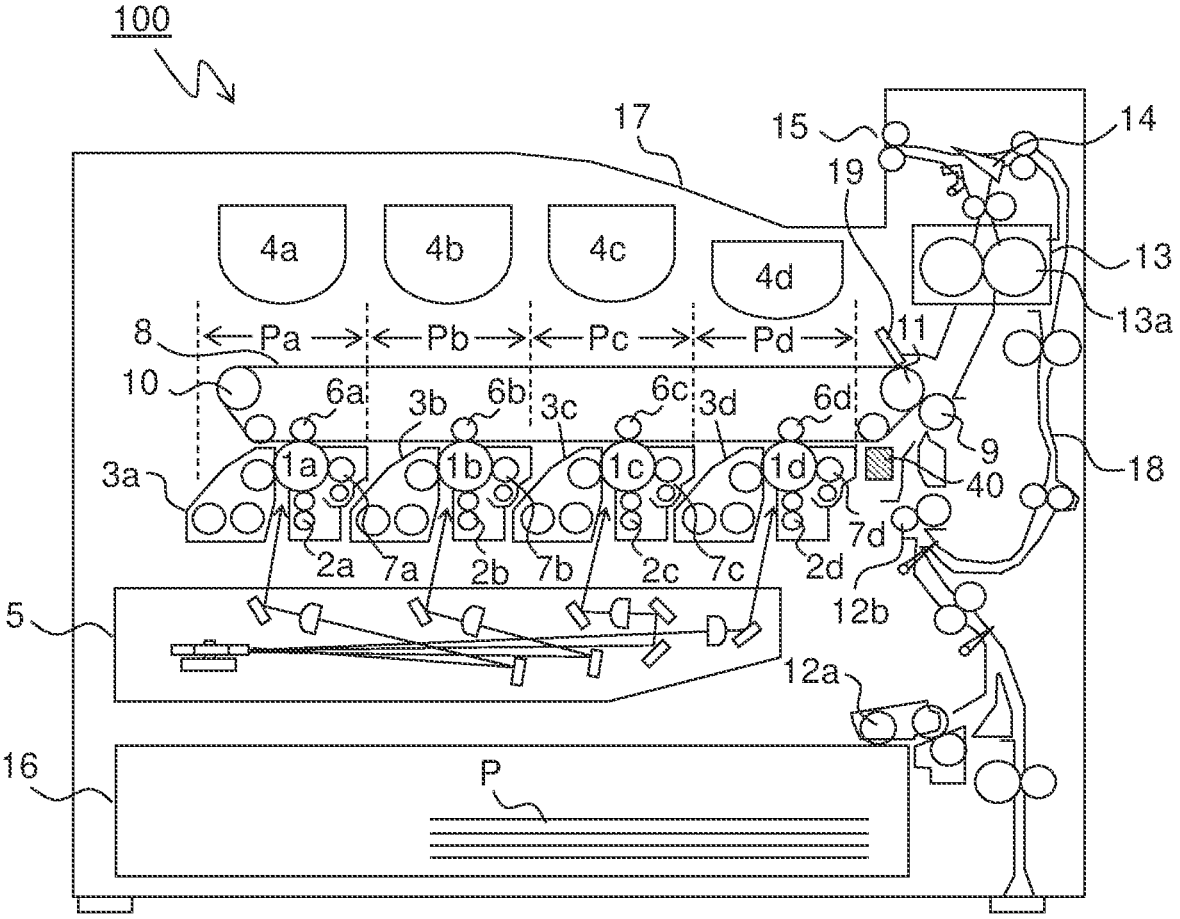
FIG. 1 is a side sectional view showing an internal structure of an image forming apparatus according to one embodiment of the present disclosure.

With reference to the appended drawings, the following describes an embodiment of the present disclosure. FIG. 1 is a sectional view showing an internal structure of an image forming apparatus 100 according to one embodiment of the present disclosure. In a main body of the image forming apparatus 100 (herein, a color printer), four image forming portions Pa, Pb, Pc, and Pd are disposed in order from an upstream side in a conveyance direction (a left side in FIG. 1). The image forming portions Pa to Pd are provided correspondingly to images of four different colors (yellow, cyan, magenta, and black), respectively, and sequentially form images of yellow, cyan, magenta, and black, respectively, by individually performing steps of charging, exposure, development, and transfer.

In the image forming portions Pa to Pd, photosensitive drums (image carrying members) 1*a*, 1*b*, 1*c*, and 1*d* are disposed, respectively, to carry visible images (toner images) of the respective colors. Moreover, an intermediate transfer belt (an intermediate transfer member) 8 that is driven by a belt drive motor (not shown) to rotate in a counterclockwise direction in FIG. 1 is provided adjacently to the image forming portions Pa to Pd. Toner images formed respectively on the photosensitive drums 1*a* to 1*d* are sequentially and primarily transferred in a superimposed manner on the intermediate transfer belt 8 moving while abutting on the photosensitive drums 1*a* to 1*d*. After that, the toner images thus primarily transferred on the intermediate transfer belt 8 are secondarily transferred by a secondary transfer roller 9 on a transfer sheet P as an example of a recording medium. Moreover, the toner images secondarily transferred to the transfer sheet P are fixed thereon in a fixing portion 13, and then the transfer sheet P is discharged from the main body of the image forming apparatus 100. An image forming process with respect to the photosensitive drums 1*a* to 1*d* is executed while the photosensitive drums 1*a* to 1*d* are rotated in a clockwise direction in FIG. 1.

The transfer sheet P on which toner images are to be secondarily transferred is housed in a sheet cassette 16 arranged in a lower part of the main body of the image forming apparatus 100. The transfer sheet P is conveyed to a nip between the secondary transfer roller 9 and a driving roller 11 of the intermediate transfer belt 8 via a paper feed roller 12*a* and a registration roller pair 12*b*. As the intermediate transfer belt 8, a seam-free (seamless) belt formed of a dielectric resin sheet is mainly used. Furthermore, a blade-shaped belt cleaner 19 for removing a residual toner or the like remaining on a surface of the intermediate transfer belt 8 is arranged on a downstream side of the secondary transfer roller 9.

Next, a description is given of the image forming portions Pa to Pd. Charging devices 2*a*, 2*b*, 2*c*, and 2*d* that charge the photosensitive drums 1*a* to 1*d*, respectively, an exposure device 5 that performs exposure based on image information with respect to the photosensitive drums 1*a* to 1*d*, developing devices 3*a*, 3*b*, 3*c*, and 3*d* that form toner images on the photosensitive drums 1*a* to 1*d*, respectively, and cleaning devices 7*a*, 7*b*. 7*c*, and 7*d* that remove a residual developer (toner) or the like remaining on the photosensitive drums 1*a* to 1*d*, respectively, are provided around and below the photosensitive drums 1*a* to 1*d* rotatably disposed.

Upon image data being inputted from a host apparatus such as a personal computer, first, surfaces of the photosensitive drums 1*a* to 1*d* are uniformly charged by the charging devices 2*a* to 2*d*, respectively. Then, by the exposure device 5, light is applied thereto so as to correspond to image data so that electrostatic latent images corresponding to the image data are formed on the photosensitive drums 1*a* to 1*d*, respectively. The developing devices 3*a* to 3*d* are filled with prescribed amounts of two-component developers including toners of yellow, cyan, magenta, and black, respectively. In a case where a percentage of the toners in the two-component developers filled in the developing devices 3*a* to 3*d* falls below a preset value due to after-mentioned toner image formation, the developing devices 3*a* to 3*d* are replenished with fresh supplies of toners from toner containers 4*a* to 4*d*, respectively. The toners in the developers are supplied onto the photosensitive drums 1*a* to 1*d* by the developing devices 3*a* to 3*d*, respectively, and electrostatically adheres thereto. Thus, there are formed toner images corresponding to the electrostatic latent images formed by exposure from the exposure device 5.

Further, by primary transfer rollers 6*a* to 6*d*, an electric field is applied at a prescribed transfer voltage between themselves and the photosensitive drums 1*a* to 1*d*, respectively. Thus, the toner images of yellow, magenta, cyan, and black on the photosensitive drums 1*a* to 1*d* are primarily transferred on the intermediate transfer belt 8. These images are formed in a prescribed positional relationship. After that, a residual toner or the like remaining on the surfaces of the photosensitive drums 1*a* to 1*d* after primary transfer is removed by the cleaning devices 7*a* to 7*d*, respectively, in preparation for subsequent formation of new electrostatic latent images.

The intermediate transfer belt 8 is stretched over a driven roller 10 on an upstream side and the driving roller 11 on a downstream side. As the driving roller 11 is driven to rotate by the belt drive motor (not shown), the intermediate transfer belt 8 starts to rotate in the counterclockwise direction, and then the transfer sheet P is conveyed at prescribed timing from the registration roller pair 12*b* to the nip (a secondary transfer nip) between the driving roller 11 and the secondary transfer roller 9 provided adjacently thereto, where the toner images on the intermediate transfer belt 8 are secondarily transferred on the transfer sheet P. The transfer sheet P on which the toner images have been secondarily transferred is conveyed to the fixing portion 13.

The transfer sheet P conveyed to the fixing portion 13 is heated and pressed by a fixing roller pair 13*a*, and thus the toner images are fixed on a surface of the transfer sheet P to form a prescribed full-color image thereon. A conveyance direction of the transfer sheet P on which the full-color image has been formed is controlled by a branch portion 14 branching off in a plurality of directions, and the transfer sheet P is directly (or after being conveyed to a double-sided conveyance path 18 and subjected to double-sided image formation therein) discharged to a discharge tray 17 by a discharge roller pair 15.

Moreover, an image density sensor 40 is arranged on a downstream side of the image forming portion 1*d* at a position opposed to the intermediate transfer belt 8. As the image density sensor 40, an optical sensor is used that includes a light-emitting element formed generally of an LED or the like and a light-receiving element formed of a photodiode or the like. In measuring an amount of a toner adhering on the intermediate transfer belt 8, measurement light is applied from the light-emitting element to reference images formed on the intermediate transfer belt 8 and then enters the light-receiving element as light reflected by the toner and light reflected by the surface of the intermediate transfer belt 8.

The light reflected from the toner and the light reflected from the surface of the intermediate transfer belt 8 include a specular reflection light component and a diffused reflection light component. The specular reflection light component and the diffused reflection light component are split with a polarization splitting prism and then enter separate light-receiving elements, respectively. Each of the light-receiving elements performs photoelectric conversion of a received one of the specular reflection light component and the diffused reflection light component and outputs an output signal to a main control portion 80 (see FIG. 3). Further, from a characteristic change in the output signal based on the received one of the specular reflection light component and the diffused reflection light component, a toner amount is detected and compared with a predetermined reference density so as to be used to adjust a characteristic value of a development voltage or the like. In this manner, density correction (calibration) is performed.

Figure 2:
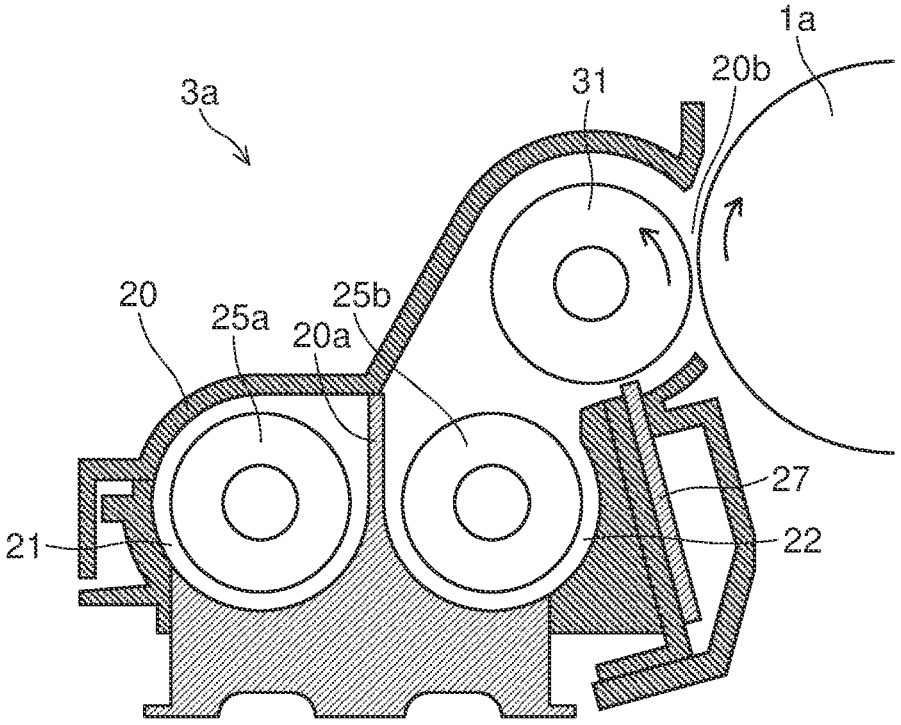
FIG. 2 is a side sectional view of a developing device mounted in the image forming apparatus.

FIG. 2 is a side sectional view of the developing device 3*a* mounted in the image forming apparatus 100. While the following describes, as an example, the developing device 3*a* arranged in the image forming portion Pa shown in FIG. 1, the developing devices 3*b* to 3*d* arranged in the image forming portions Pb to Pd, respectively, also have a basically similar configuration thereto, and thus descriptions thereof are omitted.

As shown in FIG. 2, the developing device 3*a* includes a developing container 20 for containing therein a two-component developer (hereinafter, referred to simply as a developer) including a magnetic carrier and a toner, and the developing container 20 is divided by a partition wall 20*a* into a stirring conveyance chamber 21 and a supply conveyance chamber 22. In the stirring conveyance chamber 21 and the supply conveyance chamber 22, a stirring conveyance screw 25*a* and a supply conveyance screw 25*b* for making a mixture of a toner supplied from the toner container 4*a* (see FIG. 1) and a magnetic carrier, stirring the mixture, and charging the toner are rotatably disposed, respectively. This embodiment uses a two-component developer composed of a positively chargeable toner and a ferrite/resin-coated carrier. Detailed configurations of the toner and the carrier will be described later.

Further, the developer is conveyed while being stirred by the stirring conveyance screw 25*a* and the supply conveyance screw 25*b* in an axis direction thereof (a direction perpendicular to a plane on which FIG. 2 is drawn) and circulates between the stirring conveyance chamber 21 and the supply conveyance chamber 22 via unshown developer passages formed at both ends of the partition wall 20*a*. That is, in the developing container 20, a circulation route of the developer is formed by the stirring conveyance chamber 21, the supply conveyance chamber 22, and the developer passages.

The developing container 20 extends to a diagonally upper right side in FIG. 2, and a developing roller 31 (a developer carrying member) is arranged on a diagonally upper right side of the supply conveyance screw 25*b* in the developing container 20. Further, a part of an outer circumferential surface of the developing roller 31 is exposed through an opening 20*b* of the developing container 20 and is opposed at a prescribed distance (a development gap) to the photosensitive drum 1*a*. The developing roller 31 rotates (performs trail rotation at a position opposed to the photosensitive drum 1*a*) in a counterclockwise direction in FIG. 2.

The developing roller 31 is composed of a cylindrical developing sleeve that rotates in the counterclockwise direction in FIG. 2 and a magnet (not shown) that has a plurality of magnetic poles and is secured in the developing sleeve. While the developing sleeve used herein is a developing sleeve having a knurled surface, it is also possible to use a developing sleeve having a surface with a multitude of concaves (dimples) formed therein, a developing sleeve having a blasted surface, a developing sleeve having a surface not only knurled and including concaves formed therein but also blasted, and a developing sleeve having a plated surface. By a development voltage power supply 43 (see FIG. 3), a development voltage composed of a direct-current voltage Vdc and an alternating-current voltage Vac is applied to the developing roller 31.

Furthermore, a restriction blade 27 is attached to the developing container 20 along a longitudinal direction of the developing roller 31 (a perpendicular direction to the plane on which FIG. 2 is drawn). A slight clearance (gap) is formed between a distal end of the restriction blade 27 and a surface of the developing roller 31. In this embodiment, a magnetic blade made of stainless steel (SUS430) is used as the restriction blade 27.

Figure 3:
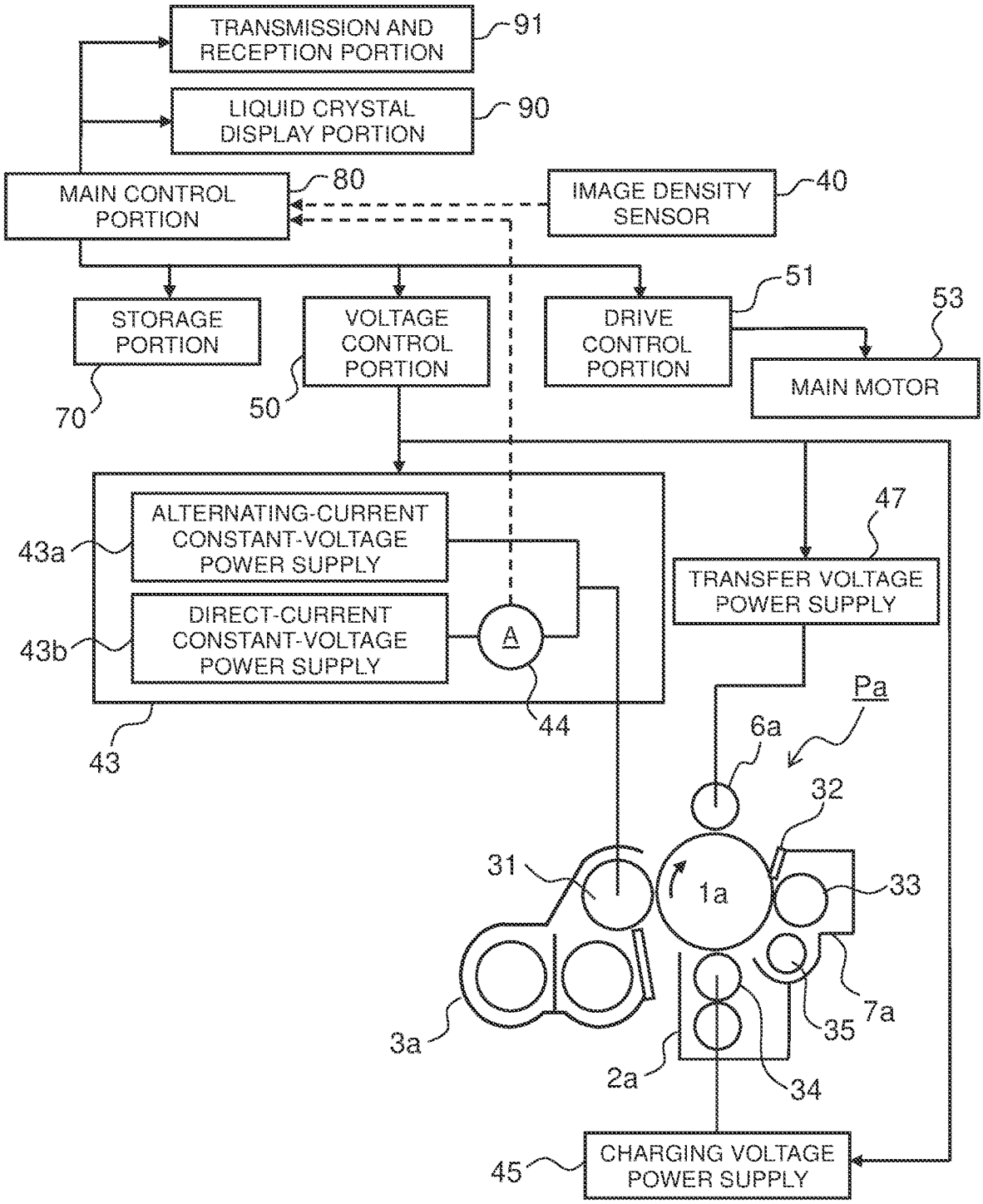
FIG. 3 is a view showing a configuration and a control route of an image forming portion.

FIG. 3 is a view showing a configuration and a control route of the image forming portion Pa including the developing device 3*a*. While the following describes the configuration and the control route of the image forming portion Pa, respective configurations and control routes of the image forming portions Pb to Pd are similar thereto, and thus descriptions thereof are omitted.

The developing roller 31 is connected to the development voltage power supply 43 that generates an oscillating voltage by superimposing a direct-current voltage and an alternating-current voltage on each other. The development voltage power supply 43 includes an alternating-current constant-voltage power supply 43*a* and a direct-current constant-voltage power supply 43*b*. The alternating-current constant-voltage power supply 43*a* outputs a sinusoidal alternating-current voltage generated from a low direct-current voltage modulated into a pulse form by use of a step-up transformer (not shown). The direct-current constant-voltage power supply 43*b* outputs a direct-current voltage obtained by rectifying a sinusoidal alternating-current voltage generated from a low direct-current voltage modulated into a pulse form by use of the step-up transformer.

During image formation, the development voltage power supply 43 outputs, from the alternating-current constant-voltage power supply 43*a* and the direct-current constant-voltage power supply 43*b*, a development voltage obtained by superimposing an alternating-current voltage on a direct-current voltage. A current detection portion 44 detects a current value of a direct current flowing between the developing roller 31 and the photosensitive drum 1*a*.

A charging voltage power supply 45 applies, to a charging roller 34 of the charging device 2*a*, a charging voltage obtained by superimposing an alternating-current voltage on a direct-current voltage. The charging voltage power supply 45 has a similar configuration to that of the development voltage power supply 43. A transfer voltage power supply 47 applies a primary transfer voltage to each of the primary transfer rollers 6*a* to 6*d* and a secondary transfer voltage to the secondary transfer roller 9 (see FIG. 1).

The cleaning device 7*a* includes a cleaning blade 32 for removing a residual toner remaining on the surface of the photosensitive drum 1*a*, a rubbing roller 33 that removes the residual toner on the surface of the photosensitive drum 1*a* and polishes, through rubbing, the surface of the photosensitive drum 1*a*, and a conveyance spiral 35 that discharges, to outside the cleaning device 7*a*, the residual toner removed from the photosensitive drum 1*a* by the cleaning blade 32 and the rubbing roller 33.

Next, with reference to FIG. 3, a description is given of a control system of the image forming apparatus 100. The image forming apparatus 100 is provided with the main control portion 80 that is formed of a CPU or the like. The main control portion 80 is connected to a storage portion 70 that is formed of a ROM, a RAM, or the like. Based on a control program or control data stored in the storage portion 70, the main control portion 80 controls the various portions (the charging devices 2*a* to 2*d*, the developing devices 3*a* to 3*d*, the exposure device 5, the primary transfer rollers 6*a* to 6*d*, the cleaning devices 7*a* to 7*d*, the secondary transfer roller 9, the fixing portion 13, the development voltage power supply 43, the current detection portion 44, the charging voltage power supply 45, the transfer voltage power supply 47, a voltage control portion 50, a drive control portion 51, and so on) of the image forming apparatus 100.

The voltage control portion 50 controls the development voltage power supply 43 that applies a development voltage to the developing roller 31, the charging voltage power supply 45 that applies a charging voltage to the charging roller 34, and the transfer voltage power supply 47 that applies transfer voltages to the primary transfer rollers 6*a* to 6*d* and the secondary transfer roller 9. The drive control portion 51 controls a main motor 53 that drives the photosensitive drums 1*a* to 1*d* to rotate. The voltage control portion 50 and the drive control portion 51 may each be formed of a control program stored in the storage portion 70.

A liquid crystal display portion 90 and a transmission and reception portion 91 are connected to the main control portion 80. The liquid crystal display portion 90 functions as a touch panel used by a user to perform various settings for the image forming apparatus 100 and displays a state of the image forming apparatus 100, an image formation status, the number of printed sheets, and so on. The transmission and reception portion 91 performs external communication by use of a telephone line or an Internet line.

In the image forming apparatus 100 of this embodiment, a carrier having a low electric resistance is used as a carrier in a two-component developer and a peak-to-peak value (Vpp) of an alternating-current component of a development voltage is set to be small, so that the occurrence of a development leak is suppressed or a size of a leak mark generated is reduced. The following describes in detail a method for setting image forming conditions and a two-component developer used.

[Setting of Development Current]

In the image forming apparatus 100 of this embodiment, a development current flowing between the developing roller 31 of each of the developing devices 3*a* to 3*d* and a corresponding one of the photosensitive drums 1*a* to 1*d* is measured, and image forming conditions are set so that the development current thus measured falls within a prescribed range. Specifically, when a surface potential of each of the photosensitive drums 1*a* to 1*d* is indicated as V0 and a direct-current component of a development voltage to be applied to the developing roller 31 is indicated as Vdc, a potential difference (V0−Vdc) between the each of the photosensitive drums 1*a* to 1*d* and the developing roller 31 has a potential difference in a direction (during development) in which the toner is moved from the developing roller 31 to the each of the photosensitive drums 1*a* to 1*d* and a potential difference in a direction in which the toner is moved from the each of the photosensitive drums 1*a* to 1*d* to the developing roller 31, and V0 or Vdc is adjusted so that these potential differences are equal in value and opposite in polarity.

For example, when V0=450 [V] is fixedly set and Vdc=550 [V] is applied to the developing roller 31, the potential difference (a first potential difference−Va) in the direction in which the toner is moved from the developing roller 31 to each of the photosensitive drums 1*a* to 1*d* is 450−550=−100 [V]. When Vdc=350 [V] is applied to the developing roller 31, the potential difference (a second potential difference Va) in the direction in which the toner is moved from the each of the photosensitive drums 1*a* to 1*d* to the developing roller 31 is 450−350=100 [V].

While the first potential difference −Va and the second potential difference Va can be set also by fixedly setting Vdc and varying V0, preferably, these potential differences are set by varying Vdc.

Next, for each of the developing devices 3*a* to 3*d*, a second development current |Ib| that flows at the second potential difference Va is detected by the current detection portion 44. Further, |Ib| is set to satisfy Expression (1) below.

$$1.9\times10^{-2}\geq|Ib|/N\geq5.7\times10\times^{-3}[\mu A/mm] \quad (1)$$

where N denotes an axial length [mm] along which a magnetic brush on a developing roller is in contact with a photosensitive drum.

In Expression (1), which defines a magnitude of the second development current |Ib|, in order to eliminate an influence of an axial length of the developing roller 31, a current value per unit axial length is defined. In a case where an electric current flowing through a magnetic brush is increased (a carrier resistance is decreased) to such a level as to satisfy Expression (1), even when the Vpp of an alternating-current component of a development voltage is set to be small, an image density can be ensured. Accordingly, at the occurrence of a development leak, a size of a leak mark generated is extremely reduced (not more than 0.5 mm), and thus even when a leak occurs, the occurrence thereof becomes hardly recognizable.

Furthermore, preferably, the first development current |Ia| that flows at the first potential difference −Va and the second development current |Ib| also satisfy Expression (2) below:

$$1.51\times|Ia|\geq|Ib|\geq0.45\times|Ia| \quad (2).$$

By satisfying Expression (2), it is possible to more effectively improve prevention of the occurrence of carrier development in a blank region and an image region, periodic unevenness in halftone image density, and a development leak.

The first development current 11*a* and the second development current |Ib| may be detected by executing a dedicated mode for performing a setting of a development current during non-image formation and adjusting V0 or Vdc to set the first potential difference −Va and the second potential difference Va or can also be detected in a non-image region (between sheets) during image formation.

Next, a description is given of a two-component developer used in the developing devices 3*a* to 3*d* of the present disclosure. The two-component developer includes a toner and a carrier. A toner concentration (a weight ratio of the toner to the carrier, T/C) in the two-component developer is preferably 5 to 20 parts by mass with respect to 100 parts by mass of the carrier.

[Toner]

For example, a positively chargeable toner can be used as the toner. The positively chargeable toner becomes positively (plus) charged by friction with the carrier. Toner particles each include a toner base particle and an external additive that adheres to a surface of the toner base particle as required. There is no particular limitation on a configuration of the toner base particle. The external additive does not need to be added when not required. In a case of not adding the external additive, the toner base particle corresponds to each of the toner particles.

The toner base particle contains a binder resin and a colorant. In the toner base particle, a mold release agent, an electric charge control agent, a magnetic powder, and so on may be contained as required. The toner base particle has a weight average particle diameter of preferably 5 to 12 μm and more preferably 6 to 10 μm. The weight average particle diameter of the toner base particle is measured using a particle size distribution measurement device (for example, Multisizer II produced by Beckman Coulter. Inc.). The toner base particle is produced by a known method such as a pulverization classification method, a melt granulation method, a spray granulation method, or a polymerization method.

In a case of adding the external additive, in order to obtain a toner having excellent fluidity, preferably, inorganic particles having a number-average primary particle diameter of not less than 5 nm and not more than 30 nm are used as the external additive. In order to obtain a toner having excellent heat-resistant storage stability by making the external additive function as a spacer between toner particles, preferably, resin particles having a number-average primary particle diameter of not less than 50 nm and not more than 200 nm are used as external additive particles. Examples of the external additive include inorganic oxides such as silica, a titanium oxide, and alumina and metallic soaps such as calcium stearate. In order to make the external additive sufficiently exert its functions while suppressing falling-off of the external additive from the toner base particle, preferably, the external additive is added in an amount of not less than 1 part by mass and not more than 10 parts by mass with respect to 100 parts by mass of the toner base particle.

The toner particles may be toner particles each not having a shell layer (non-capsule toner particles) or toner particles each having the shell layer (capsule toner particles). The capsule toner particles each include a toner base particle having a toner core and the shell layer that covers a surface of the toner core. There is no particular limitation on a configuration of the toner core. The shell layer may be substantially made only of a thermosetting resin, may be substantially made only of a thermoplastic resin, or may contain both of the thermoplastic resin and the thermosetting resin. In order to obtain a toner suitable for image formation, preferably, the toner base particle has a volume average particle diameter (D50) of not less than 4 μm and not more than 9 μm.

Moreover, in each of the toner particles, a hydrophobic silica particle and a styrene-acrylate resin fine particle are made to adhere to the toner base particle. The hydrophobic silica particle acts as a charge adjustment agent that adjusts a toner charge amount. The styrene-acrylate resin fine particle acts as a spacer for preventing the silica particle from being embedded in the toner base particle. While typically adhering to a surface of the carrier during endurance to cause a decrease in charging performance of the carrier, the styrene-acrylate resin fine particle has weak adhesion to a silicone resin coat layer containing an after-mentioned ferroelectric particle and thus is prevented from continuously and increasingly accumulating on the carrier. While a detailed principle is unknown, presumably, this is because the styrene-acrylate resin fine particle has little adhesion to a ferroelectric substance exposed on a surface of the coat layer and thus is likely to be peeled off therefrom.

[Carrier]

The carrier used in the present disclosure includes a carrier core that is a particle of a magnetic substance and the coat layer that is made of a silicone resin or the like and is formed on a surface of the carrier core. A silicone-based resin can be applied to form a thin coat film, thus enhancing uniformity of the coat layer. Furthermore, the smaller a thickness of the coat layer, the higher a capacitance of the coat layer, and thus an effect of the ferroelectric substance added to the coat layer becomes likely to be exerted.

The carrier can be of a varying shape from indefinite to spherical. Moreover, as the carrier, a carrier having an average particle diameter (a number-average particle diameter) of not less than 20 μm and not more than 65 μm can be used. When having an average particle diameter of not more than 65 μm, the carrier is increased in specific surface area and thus can carry an increased amount of the toner. Thus, a toner concentration in a magnetic brush can be maintained high, and the toner is therefore sufficiently supplied to the developing roller 31, so that a toner layer having a sufficient thickness can be formed. As a result, it is possible to cause a sufficient amount of the toner to fly from the toner layer to an electrostatic latent image on a photosensitive member, to suppress a decrease in image density, and to suppress unevenness in the image density. Furthermore, since the toner is sufficiently supplied to the developing roller 31, it becomes unlikely that a toner dropout region is formed in the toner layer of the developing roller 31, thus suppressing the occurrence of a hysteresis.

When the carrier has an average particle diameter smaller than 20 μm, there occurs carrier development in which the carrier adheres to the photosensitive drums 1*a* to 1*d*. The carrier that has adhered thereto might shift to the intermediate transfer belt 8 to cause a transfer void or move to the belt cleaner 19 to cause a cleaning failure. Furthermore, when the carrier has an average particle diameter larger than 65 μm, with the toner in the two-component developer moving from the developing roller 31 to any of the photosensitive drums 1*a* to 1*d*, a coarse magnetic brush of the two-component developer is formed to degrade image quality.

Examples of a material of the carrier core include magnetic metals such as iron, nickel, and cobalt, alloys thereof, alloys containing rare earths, soft ferrites such as hematite, magnetite, manganese-zinc-based ferrite, nickel-zinc-based ferrite, manganese-magnesium-based ferrite, and lithium-based ferrite, iron-based oxides such as copper-zinc-based ferrite, and mixtures thereof. The carrier core is produced by a known method such as sintering or atomization. Among carriers made of the above-described materials, ferrite carriers have excellent fluidity and are also chemically stable and thus are favorably used from viewpoints of enhancing image quality and prolonging service life.

As the ferroelectric substance, barium titanate particles are added to the coat layer. While hydrothermal polymerization, an oxalate method, or the like is used to produce barium titanate, barium titanate has physical properties varying depending on a production method thereof. When produced by the hydrothermal polymerization in particular, barium titanate has hollows therein and thus has a small absolute specific gravity and a sharp particle diameter distribution. As a result, compared with a case of being produced by any other production method, barium titanate produced by the hydrothermal polymerization has excellent dispersibility in a coat resin and thus can be dispersed uniformly. Accordingly, the charging performance of the carrier is also made uniform, and thus the hydrothermal polymerization is suitably used in the present disclosure.

Preferably, barium titanate has a volume average particle diameter of not less than 100 nm and not more than 500 nm. When having a particle diameter smaller than 100 nm, barium titanate is abruptly decreased in relative dielectric constant, so that an effect thereof related to the relative dielectric constant is reduced. On the other hand, when having a particle diameter of not less than 500 nm, barium titanate can hardly be uniformly dispersed in the coat layer.

When barium titanate is added in an amount of not less than 5 parts by mass with respect to a coat weight, an effect of stabilizing a charge amount starts to manifest itself, and when barium titanate is added in an amount of not less than 25 parts by mass with respect thereto, the effect of stabilizing a charge amount is more remarkably exhibited. When added in an excessively large amount, however, barium titanate can no longer be completely contained in the coat layer and might be partly liberated from the coat layer. A liberated part of the barium titanate might move to the photosensitive drums 1*a* to 1*d* and further into an edge part of the cleaning blade 32 of each of the cleaning devices 7*a* to 7*d*, resulting in causing a cleaning failure. Particularly in a method in which toners in the toner containers 4*a* to 4*d* are each mixed with a carrier and then are replenished to the developing devices 3*a* to 3*d*, respectively, a part of barium titanate liberated through use thereof is supplied to the developing devices 3*a* to 3*d* to increase a load on the cleaning blade 32. For this reason, preferably, barium titanate is added in an amount of not less than 5 parts by mass and not more than 45 parts by mass.

As an electric conductor, carbon black is added to the coat layer. When the carbon black is added in an excessively large amount, a part of the carbon black liberated from the coat layer might adhere to the toner, causing color turbidity of toners of colors other than black. On the other hand, when the carbon black is added in an excessively small amount, it is unlikely that electric charge moves from the carrier to the toner, resulting in a failure to cause a smooth increase in toner charge amount. In the carrier of the present disclosure, barium titanate (the ferroelectric substance) is added to the coat layer so that a carrier resistance is decreased, and thus an amount of carbon black to be added can be reduced by an amount corresponding to a decrease in the carrier resistance.

Adding the ferroelectric substance (barium titanate) to the coat layer enhances an electric charge retaining capability of the carrier, thus enabling sufficient electric charge to be applied to the toner. Furthermore, adding the electric conductor (carbon black) to the coat layer enables smooth movement of electric charge from the carrier to the toner. Even when a toner concentration is increased to increase the number of toner particles to be charged, synergy between the above-described two additives enables electric charge to be applied to a saturation level of a charge amount of the toner particles.

In producing the image forming apparatus 100, the above-described two-component developer is used, and image forming conditions satisfying Expressions (1) and (2) are set, so that it is possible to suppress the occurrence of a development leak and to reduce a size of a leak mark generated. It is also possible to suppress image fogging, a decrease in image density, and edge enhancement.

Furthermore, barium titanate having a high hardness is added as the ferroelectric substance to the coat layer of the carrier, so that abrasion of the coat layer is reduced, thus making it possible to achieve a longer service life of the carrier. Furthermore, with barium titanate added, a carrier resistance is decreased compared with a case where only carbon black is added, and thus an amount of carbon black to be added can be reduced. As a result, it is possible to suppress color turbidity resulting from adhesion of carbon black to the toner. Moreover, the carrier is improved in electric charge imparting performance, and thus even when a toner concentration in the developer is increased, a change in toner charge amount is reduced. As a result, the toner charge amount is stabilized, and thus an image density can be stably maintained.

Even when a setting for satisfying Expressions (1) and (2) has been performed in producing the image forming apparatus 100, as endurance printing progresses, Expressions (1) and (2) may no longer be satisfied due to deterioration of the two-component developer, a change in environmental conditions, or the like. As a solution to this, every time the number of printed sheets reaches a prescribed number, the first development current $|Ia|$ and the second development current $|Ib|$ are detected, and based on a result of the detection, a development voltage (particularly, a Vpp of an alternating-current component) is adjusted to satisfy Expressions (1) and (2), so that it is possible to suppress the generation of a leak mark over a long period of time.

Figure 4:
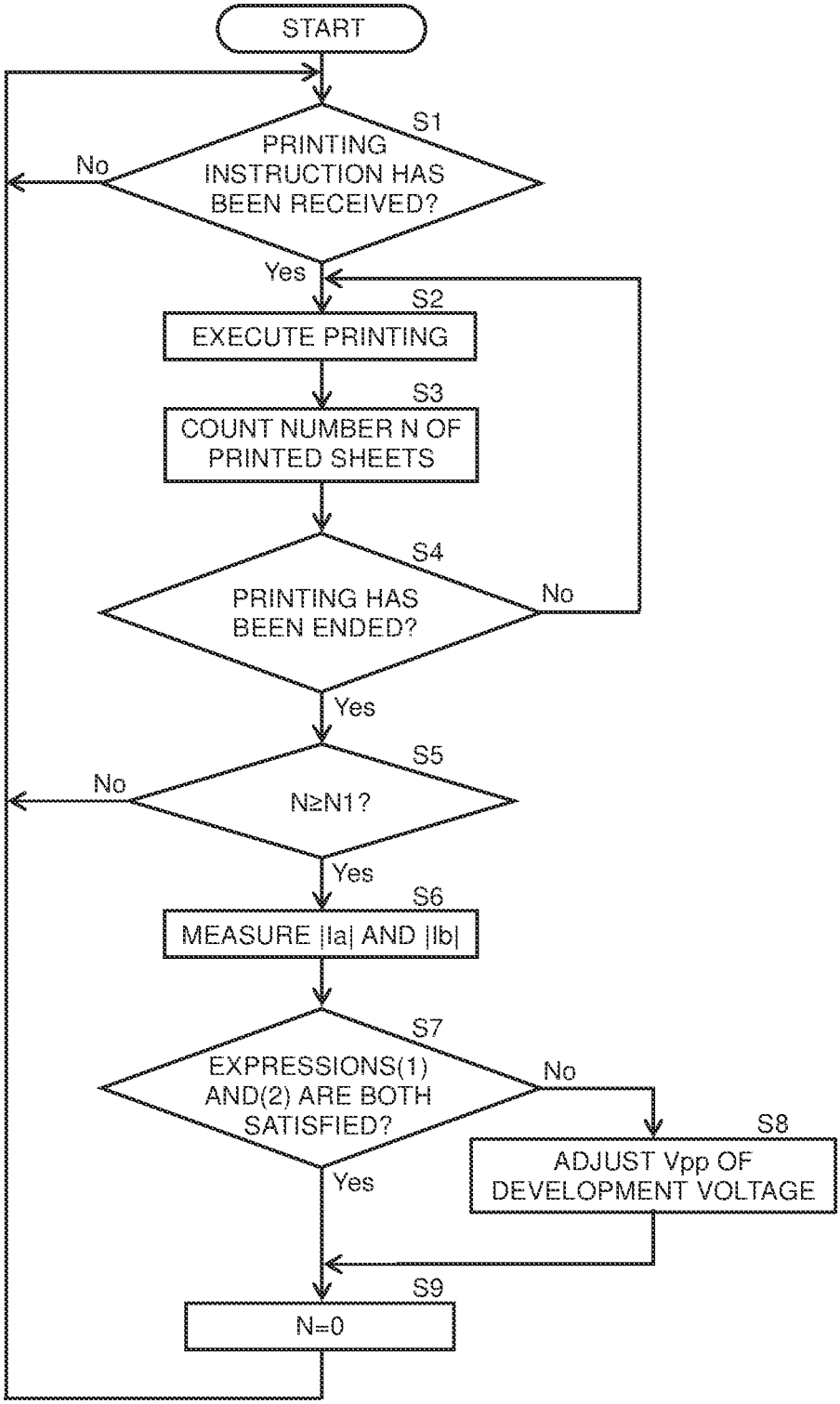
FIG. 4 is a flow chart showing an example of development voltage control in the image forming apparatus of the embodiment.

FIG. 4 is a flow chart showing an example of development voltage control in the image forming apparatus 100 of the present disclosure. With reference to FIG. 1 to FIG. 3 as required, while following steps shown in FIG. 4, a detailed description is given of a development voltage control procedure with respect to the developing devices 3*a* to 3*d*.

First, the main control portion 80 determines whether or not a printing instruction has been received (step S1). When the printing instruction has been received (Yes at step S1), printing is executed in each of the image forming portions Pa to Pd (step S2), and a number N of printed sheets is counted (step S3).

Next, the main control portion 80 determines whether or not the printing has been ended (step S4). When the printing has still been continued (No at step S4), a return is made to step S2, where execution of the printing and counting of the number N of printed sheets are continuously performed (steps S2 and S3). When the printing has been ended (Yes at step S4), the main control portion 80 determines whether or not the number N of printed sheets has reached a prescribed number N1 (for example, 1000 sheets) (step S5). When N<N1 (No at step S5), a return is made to step S1, where a printing instruction standby state is continued.

When N≥N1 (Yes at step S5), the first development current |Ia| and the second development current |Ib| are measured (step S6). Further, it is determined whether or not measured values of the first development current |Ia| and the second development current |Ib| satisfy both of Expressions (1) and (2) (step S7).

When the measured values do not satisfy, either one of Expressions (1) and (2) (No at step S7), by transmitting a control signal to the voltage control portion 50 so as to control the alternating-current constant-voltage power supply 43*a*, the main control portion 80 adjusts a Vpp of an alternating-current component of a development voltage so that Expressions (1) and (2) are satisfied (step S8). After that, the number N of printed sheets is reset (N=0) (step S9), and a return is made to step S1. On the other hand, when Expressions (1) and (2) are both satisfied at step S7 (Yes at step S7), the number N of printed sheets is reset (N=0) without the Vpp being adjusted (step S9), and a return is made to step S1.

According to the control example shown in FIG. 4, a Vpp of a development voltage is adjusted so that the first development current |Ia| and the second development current |Ib| satisfy Expressions (1) and (2), and thus regardless of an environmental change or deterioration of the carrier in endurance printing, it is possible to suppress the occurrence of a development leak over a long period of time or reduce a size of a leak mark generated and to suppress carrier development and periodic unevenness in halftone image density.

Furthermore, in a case where the image forming apparatus 100 employs a system in which a two-component developer is obtained by mixing a carrier into each of toners in the toner containers 4*a* to 4*d* and then is replenished to a corresponding one of the developing devices 3*a* to 3*d*, a content rate of barium titanate in the coat layer of the carrier included in the developer filled in each of the developing devices 3*a* to 3*d* at the start of use of the developing devices 3*a* to 3*d* is set to be different from a content rate of barium titanate in a coat layer of the carrier included in the developer in each of the toner containers 4*a* to 4*d*, and thus it is possible to suppress a variation in toner charge amount in the developing devices 3*a* to 3*d*.

In a case where the content rate of barium titanate in the carrier is low, the toner charge amount rises little by little from an initial stage to come to a state of an excessive rise (overshoot) once and then decreases to be stabilized. On the other hand, in a case where the content rate of barium titanate is high, the above-described phenomenon does not occur, and the charge amount gradually rises to be stabilized with time. The toner charge amount thus stabilized at this time is lower than that in the case where the content rate of barium titanate is low.

Based on the above, the content rate of barium titanate in the developer filled in each of the developing devices 3*a* to 3*d* at the start of use thereof is set high, while the content rate of barium titanate in the developer in each of the toner containers 4*a* to 4*d* is set low, and thus it is possible to suppress a rise in toner charge amount in the initial stage of use of the developing devices 3*a* to 3*d* and to make the toner charge amount (a stable charge amount) during endurance remain at relatively high values.

Other than the above, the present disclosure is not limited to the foregoing embodiment and can be variously modified without departing from the spirit of the present disclosure. For example, while the foregoing embodiment exemplarily describes the color printer shown in FIG. 1 as the image forming apparatus 10, the present disclosure is not limited to a color printer and is applicable also to various types of image forming apparatuses including a developing device that employs the two-component development method, such as monochrome and color copy machines, a monochrome printer, and a digital multi-functional peripheral. The following more specifically describes the effects of the present disclosure with reference to examples.

Example 1

[Production of Carrier Containing Ferroelectric Particles]

Production Example 1

By use of a homomixer, 200 parts by mass of a silicone resin (KR-255 produced by Shin-Etsu Chemical Co., Ltd. and having a nonvolatile content of 50%), 35 parts by mass of barium titanate (produced by Sakai Chemical Industry Co., Ltd. and having a volume average particle diameter of 304 nm), 10 parts by mass of carbon black (Ketjenblack EC produced by Lion Corporation), and 800 parts by mass of toluene were dispersed to provide a coat solution. The coat solution thus obtained was sprayed using a fluidized-bed coating device over 5 kg of a carrier core (an Mn ferrite carrier having a volume average particle diameter of 34.7 μm, a saturation magnetization of 80 emu/g, and a coercive force of 8 Oe and produced by Dowa IP Creation Co., Ltd.) under heating at 70° C. to 80° C. so that the carrier core was coated with the coat solution. After that, the carrier core was calcined for an hour at 250° C. using an electric furnace, was cooled down, and then was crushed and classified using a sieve to provide a carrier (a carrier 1) that included a coat layer containing ferroelectric particles.

The volume average particle diameters (D50) of barium titanate and the carrier core were measured using a laser diffraction/scattering-type particle size distribution measurement device (LA-950 produced by Horiba, Ltd.).

Production Example 2

A carrier 2 was obtained by a similar method to Production Example 1, except that a blending amount of carbon black was changed to 9 parts by mass.

Production Example 3

A carrier 3 was obtained by a similar method to Production Example 1, except that the blending amount of carbon black was changed to 7 parts by mass.

Production Example 4

A carrier 4 was obtained by a similar method to Production Example 1, except that the blending amount of carbon black was changed to 5 parts by mass.

Production Example 5

A carrier 5 was obtained by a similar method to Production Example 1, except that the blending amount of carbon black was changed to 4 parts by mass.

Production Example 6

A carrier 6 was obtained by a similar method to Production Example 1, except that the blending amount of carbon black was changed to 3 parts by mass.

Production Example 7

A carrier 7 was obtained by a similar method to Production Example 1, except that the blending amount of carbon black was changed to 2 parts by mass.

Production Example 8

A carrier 8 was obtained by a similar method to Production Example 1, except that the blending amount of carbon black was changed to 1 part by mass.

Production Example 9

A carrier 9 was obtained by a similar method to Production Example 1, except that blending amounts of barium titanate and carbon black were changed to 5 parts by mass and 7 parts by mass, respectively.

Production Example 10

A carrier 10 was obtained by a similar method to Production Example 1, except that the blending amounts of barium titanate and carbon black were changed to 25 parts by mass and 7 parts by mass, respectively.

Production Example 11

A carrier 11 was obtained by a similar method to Production Example 1, except that the blending amounts of barium titanate and carbon black were changed to 45 parts by mass and 7 parts by mass, respectively.

Production Example 12

A carrier 12 was obtained by a similar method to Production Example 1, except that the volume average particle diameter of barium titanate was changed to 102 nm, and the blending amount of carbon black was changed to 7 parts by mass.

Production Example 13

A carrier 13 was obtained by a similar method to Production Example 1, except that the volume average particle diameter of barium titanate was changed to 304 nm, and the blending amount of carbon black was changed to 7 parts by mass.

Production Example 14

A carrier 14 was obtained by a similar method to Production Example 1, except that the volume average particle diameter of barium titanate was changed to 495 nm, and the blending amount of carbon black was changed to 7 parts by mass.

Production Examples 15 and 16

Carriers 15 and 16 varying in average film weight were obtained by a similar method to Production Example 1, except that the blending amount of carbon black was changed to 7 parts by mass, and an amount of the coat solution to be sprayed and a length of spraying time were changed.

Example 21

[Evaluation of Image Obtained Using Ferroelectric Particle-Containing Carrier]

There was performed an evaluation of an image obtained by printing using each of the ferroelectric particle-containing carriers produced in Example 1. In a test method, the developing devices 3*a* to 3*d* configured as shown in FIG. 2 were filled with two-component developers including each of the carriers 1 to 16 produced in Production Examples 1 to 16, respectively, and were mounted in a test apparatus.

Using this test apparatus, endurance printing of test images varying in coverage rate from 2% to 50% was performed at a printing velocity (a process velocity) of 55 sheets per minute. To be more detailed, intermittent printing of five sheets at a time was performed by varying the coverage rate in a stepwise manner in which the coverage rate for the 0th to 1000th sheets was 2%, the coverage rate for the 1001st to 2000th sheets was 5%. Further, there were performed evaluations on three items that are the generation of a leak mark, carrier development, and periodic unevenness in halftone image density after printing of a total of 100000 sheets. The above-described endurance test was performed under three different conditions that are a low temperature and humidity environment (10° C., 15%), a room temperature and humidity environment (22° C., 50%), and a high temperature and humidity environment (32.5° C., 80%).

Development conditions were as follows. That is, used as the developing roller 31 was a roller having an outer circumferential surface in which 80 rows of concaves were formed (knurled) and an outer diameter of 20 mm, and used as the restriction blade 27 was a magnetic blade made of stainless steel (SUS430) and having a thickness of 1.5 mm. A developer conveyance amount of the developing roller 31 was 275 to 400 g/m$^2$, and the developing roller 31 was set to rotate (perform trail rotation at an opposed position) at a circumferential velocity ratio of 1.8 with respect to each of the photosensitive drums 1*a* to 1*d* and to be at a distance (a development gap) of 250 to 400 μm from each of the photosensitive drums 1*a* to 1*d*. A development voltage obtained by superimposing an alternating-current voltage having a peak-to-peak value (Vpp) of 750 to 1480 V, a frequency of 10 kHz, and a duty of 50% on a direct-current voltage of 50 to 250 V was applied to the developing roller 31.

The photosensitive drums 1*a* to 1*d* were formed of an amorphous silicon (a-Si) photosensitive member having a relative dielectric constant of 11, the distance (a DS (drum-sleeve) distance) between each of the photosensitive drums 1*a* to 1*d* and the developing roller 31 was set to 0.375±0.025 mm, and the developer conveyance amount of the developing roller 31 was set to 350±50 g/m$^2$. As a toner, a positively chargeable toner having an average particle diameter of 6.8 μm was used, and an initial toner concentration in the developers (a weight ratio of the toner to each of the carriers) was set to 6%.

An evaluation method was adopted in which leak marks generated per 100 sheets of images were sorted into a group having a diameter of not less than 1 mm and another group having a diameter between 1 and 0.5 mm, and the number of leak marks in each of these groups was visually counted.

As for carrier development, separate evaluations were performed on carrier development in a blank region and carrier development in an image region. The evaluation on the carrier development in the blank region was performed by magnifying an image with a magnifier. In evaluation criteria, a case where carrier development occurred to a very annoying degree was indicated as "P (poor)." a case where carrier development occurred to a somewhat annoying degree as "F (fair)," and a case where a degree of occurrence of carrier development was not annoying at all as "G (good)."

The evaluation on the carrier development in the image region was performed based on a transfer void in a solid image. The transfer void is a phenomenon in which an electric charge injection resulting from application of a development voltage causes the carrier to have the same polarity as that of the toner, and thus the carrier is developed in a solid image region and exerts a spacer effect to hamper transfer. Specifically, due to the carrier developed in the solid image region, a distance is generated between the photosensitive member and a transfer destination member (an intermediate transfer belt or a sheet), causing the toner surrounding the carrier to fail to be transferred, so that a blank spot is generated in the solid image. In evaluation criteria, a case where voids were generated to a very noticeable degree was indicated as "P (poor)," a case where voids were generated but not to an annoying level as "F (fair)," and a case where no voids were generated or a degree of generation of voids was unnoticeable as "G (good)."

The evaluation on periodic unevenness in halftone image density was performed based on a gradation difference at a developing roller pitch in a halftone image having a coverage rate of 25%. In evaluation criteria, a case where the periodic unevenness occurred to a very noticeable degree was indicated as "P (poor)," a case where the periodic unevenness occurred but not to an annoying degree as "F (fair)," and a case where no such periodic unevenness occurred or a degree of occurrence of the periodic unevenness was unnoticeable as "G (good)." Table 1 shows coat layers and development currents of the carriers 1 to 16, and Table 2 shows development conditions and results of image evaluations. The results of evaluations are each a summary of results under the three different environmental conditions.

TABLE 1

| | Coat Layer | | | | | | | |
|---|---|---|---|---|---|---|---|---|
| | | Barium Titanate | | | | Development Current | | |
| No | Resin | Blending Amount [Part] | Average Particle Diameter [nm] | C.B* Blending Amount [Part] | Average Film Weight [g/m^2] | \|Ie\|/N [μA/mm] | \|Ib\|/N [μA/mm] | \|Ib\|/\|Ie\| |
| 1 | Si | 35 | 304 | 10 | 0.24 | 1.3E−02 | 2.1E−02 | 1.67 |
| 2 | Si | 35 | 304 | 9 | 0.24 | 1.3E−02 | 1.9E−02 | 1.51 |
| 3 | Si | 35 | 304 | 7 | 0.24 | 1.3E−02 | 1.6E−02 | 1.27 |
| 4 | Si | 35 | 304 | 5 | 0.24 | 1.3E−02 | 1.2E−02 | 0.97 |
| 5 | Si | 35 | 304 | 4 | 0.24 | 1.3E−02 | 1.1E−02 | 0.87 |
| 6 | Si | 35 | 304 | 3 | 0.24 | 1.3E−02 | 8.2E−03 | 0.65 |
| 7 | Si | 35 | 304 | 2 | 0.24 | 1.3E−02 | 5.7E−03 | 0.45 |
| 8 | Si | 35 | 304 | 1 | 0.24 | 1.3E−02 | 5.2E−03 | 0.41 |
| 9 | Si | 5 | 304 | 7 | 0.24 | 1.1E−02 | 1.9E−02 | 1.73 |
| 10 | Si | 25 | 304 | 7 | 0.24 | 1.3E−02 | 1.1E−02 | 0.84 |
| 11 | Si | 45 | 304 | 7 | 0.24 | 1.3E−02 | 7.4E−03 | 0.57 |
| 12 | Si | 35 | 102 | 7 | 0.24 | 1.6E−02 | 6.3E−03 | 0.39 |
| 13 | Si | 35 | 304 | 7 | 0.24 | 1.6E−02 | 1.7E−02 | 1.06 |
| 14 | Si | 35 | 495 | 7 | 0.24 | 1.6E−02 | 5.7E−03 | 0.36 |
| 15 | Si | 35 | 304 | 7 | 0.2 | 2.0E−02 | 1.0E−02 | 0.50 |
| 16 | Si | 35 | 304 | 7 | 0.27 | 2 0E−02 | 1.5E−02 | 0.73 |

*Carbon Black

TABLE 2

| | Development Condition | | | Image Evaluation | | | | | |
|---|---|---|---|---|---|---|---|---|---|
| | | | | Leak Mark | | Carrier Development | | Periodic Unevenness is Halftone | |
| No | Development Gap [μm] | Developer Conveyance Amount [g/m2] | Development Vpp [V] | 1 mm or Larger | 0.5~1 | Blank Region | Image Region | Image Density | Comprehensive Evaluation |
| 1 | 375 | 350 | 930 | 0 | 0 | P | G | G | P |
| 2 | 375 | 350 | 950 | 0 | 0 | G | G | G | G |
| 3 | 375 | 350 | 980 | 0 | 0 | G | G | G | G |
| 4 | 375 | 350 | 1130 | 0 | 0 | G | G | G | G |
| 5 | 375 | 350 | 1140 | 0 | 0 | G | G | G | G |
| 6 | 375 | 350 | 1300 | 0 | 0 | G | G | G | G |
| 7 | 375 | 350 | 1420 | 0 | 0 | G | G | G | G |
| 8 | 375 | 350 | 1480 | 0 | 0 | G | G | G | P |

TABLE 2-continued

| | Development Condition | | | Image Evaluation | | | | | |
|---|---|---|---|---|---|---|---|---|---|
| | | | | | | | | Periodic | |
| | Development | Developer Conveyance | Development | Leak Mark | | Carrier Development | | Unevenness is Halftone | Compre- |
| No | Gap [μm] | Amount [g/m2] | Vpp [V] | 1 mm or Larger | 0.5~1 | Blank Region | Image Region | Image Density | hensive Evaluation |
| 9 | 375 | 350 | 1070 | 0 | 0 | G | F | G | F |
| 10 | 350 | 350 | 1050 | 0 | 0 | G | G | G | G |
| 11 | 275 | 275 | 825 | 0 | 0 | G | G | G | G |
| 12 | 300 | 300 | 900 | 0 | 0 | G | G | F | F |
| 13 | 250 | 300 | 750 | 0 | 0 | G | G | G | G |
| 14 | 325 | 325 | 975 | 0 | 0 | G | G | F | F |
| 15 | 375 | 350 | 1125 | 0 | 0 | G | G | G | G |
| 16 | 400 | 400 | 1200 | 0 | 0 | G | G | G | G |

As is apparent from Table 2, in a case of the carrier 1 containing carbon black in a blending amount of 10 parts by mass and having a value of |Ia| exceeding an upper limit value of Expression (1), a carrier resistance was decreased, and carrier development occurred significantly in the blank region. Furthermore, in a case of the carrier 8 containing carbon black in a bending amount of 1 part by mass and having a value of |Ia| exceeding a lower limit value of Expression (1), electric charge movement hardly occurred, and leak marks were generated significantly.

Furthermore, in a case of the carrier 9 containing barium titanate in a blending amount of 5 parts by mass, the effect of stabilizing a charge amount was small, and carrier development occurred in the image region. In cases of the carrier 12 containing barium titanate having an average particle diameter of 102 μm and the carrier 14 containing barium titanate having an average particle diameter of 495 μm, periodic unevenness in halftone image density was observed.

The above-described results have confirmed that in cases of the carriers 2 to 7 and 9 to 16 having a value of |Ia| satisfying Expression (1), it is possible to suppress the generation of a leak mark and carrier development in the blank region, and that when barium titanate having a volume average particle diameter of 100 to 500 nm is contained in a blending amount of not less than 5 parts by mass and not more than 45 parts by mass, preferably, not less than 25 parts by mass and not more than 35 parts by mass, and carbon black is contained in a blending amount of 2 to 9 parts by mass, it is possible to suppress carrier development in the image region and periodic unevenness in halftone image density.

While the results described herein were obtained by using a carrier core having a volume average particle diameter of 34.7 μm and a saturation magnetization of 80 emu/g, it has been confirmed that similar results can be obtained also by using a carrier core having a volume average particle diameter of 30 to 60 μm and a saturation magnetization of 70 to 90 emu/g.

The present disclosure is usable in an image forming apparatus including a developing device that employs the two-component development method using a two-component developer including a toner and a carrier. Through the use of the present disclosure, it is possible to provide an image forming apparatus capable of suppressing the occurrence of a development leak or reducing a size of a leak mark generated in the two-component development method and also capable of maintaining image quality.

What is claimed is:

1. An image forming apparatus, comprising:

a photosensitive member having a surface on which an amorphous silicon photosensitive layer is formed;

a charging device that charges the surface of the photosensitive member to a prescribed surface potential;

an exposure device that performs exposure with respect to the surface of the photosensitive member so as to form an electrostatic latent image thereon;

a developing device including:

a developer carrying member that is arranged to be opposed to the photosensitive member and carries a two-component developer including a toner and a carrier, the developing device causing the toner to adhere to the electrostatic latent image formed on the photosensitive member so as to form a toner image thereon;

a development voltage power supply that applies, to the developer carrying member, a development voltage obtained by superimposing an alternating-current voltage on a direct-current voltage, and a control portion that controls the charging device, the exposure device, the developing device, and the development voltage power supply, wherein when a surface potential of the photosensitive member during image formation is indicated as V0 and a direct-current component of the development voltage to be applied to the developer carrying member as Vdc, and a potential difference V0−Vdc between the photosensitive member and the developer carrying member has a first potential difference in a direction in which the toner is moved from the developer carrying member to the photosensitive member and a second potential difference in a direction in which the toner is moved from the photosensitive member to the developer carrying member, the control portion adjusts V0 or Vdc so that the first potential difference and the second potential difference are equal in value and opposite in polarity, and when a first development current that flows between the photosensitive member and the developer carrying member at the first potential difference is indicated as |Ia| and a second development current that flows between the photosensitive member and the developer carrying member at the second potential difference as |Ib|, the second development current |Ib| satisfies Expression (1) below:

$$1.9\times10^{-2} \geq |Ib|/N \geq 5.7\times10^{-3} [\mu A/mm] \quad (I)$$

where N denotes an axial length [mm] along which a magnetic brush on the developer carrying member is in contact with the photosensitive member.

2. The image forming apparatus according to claim 1, wherein the first development current |Ia| and the second development current |Ib| satisfy Expression (2) below:

$$1.51\times|Ia|\geq|Ib|\geq0.45\times|Ia| \quad (2).$$

3. The image forming apparatus according to claim 2, further comprising:

a current detection portion that detects a direct-current component of the development currents flowing between the photosensitive member and the developer carrying member when the development voltage is applied to the developer carrying member, wherein when the first development current |Ia| and the second development current |Ib| detected by the current detection portion do not satisfy at least one of Expressions (1) and (2), the control portion adjusts a peak-to-peak value of an alternating-current component of the development voltage so that the first development current |Ia| and the second development current |Ib| satisfy both of Expressions (1) and (2).

4. The image forming apparatus according to claim 3, wherein the control portion detects the first development current 11*a* and the second development current |Ib| every time a number of printed sheets reaches a prescribed number and adjusts, based on a result of the detection, the peak-to-peak value of the alternating-current component of the development voltage.

5. The image forming apparatus according to claim 1, wherein the carrier includes:

a carrier core that is a particle of a magnetic substance; and a coat layer that is made of a resin and is formed on a surface of the carrier core, the coat layer containing carbon black as an electric conductor and barium titanate as a ferroelectric substance, and when the carrier core is assumed to be truly spherical, the coat layer has an average weight per unit area of 0.2 to 2.7 [g/m$^2$], and the barium titanate is added in an amount of 5 to 45 parts by mass with respect to 100 parts by mass of a coat resin forming the coat layer.

6. The image forming apparatus according to claim 5, wherein the barium titanate is added in an amount of 25 to 45 parts by mass with respect to 100 parts by mass of the coat resin.

7. The image forming apparatus according to claim 5, wherein the barium titanate has a volume average particle diameter of not less than 100 nm and not more than 500 nm.

8. The image forming apparatus according to claim 5, wherein the toner includes:

a toner base particle; and a hydrophobic silica particle and a styrene-acrylate resin fine particle that are made to adhere to the toner base particle.

9. The image forming apparatus according to claim 5, further comprising:

a toner container that stores the toner to be replenished to the developing device, wherein a developer replenishing method is employed in which the developer is obtained by mixing the carrier into the toner in the toner container and then is replenished to the developing device, and a content rate of the barium titanate in the carrier included in the developer filled in the developing device at a start of use of the developing device is higher than a content rate of the barium titanate in the carrier included in the developer in the toner container.

* * * * *